US006571502B1

(12) United States Patent
Mikuta

(10) Patent No.: US 6,571,502 B1
(45) Date of Patent: Jun. 3, 2003

(54) ELECTRONICALLY FIRED REVOLVER UTILIZING A LATCH MECHANISM BETWEEN TRIGGER AND HAMMER TO IMPLEMENT FIRING

(75) Inventor: Richard Mikuta, Easthampton, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 10/029,460

(22) Filed: Dec. 20, 2001

(51) Int. Cl.[7] ..... F41A 19/00
(52) U.S. Cl. ..... 42/84; 42/69.03; 42/65
(58) Field of Search ..... 42/84, 59–68, 42/69.03

(56) References Cited

U.S. PATENT DOCUMENTS

| | | | | | |
|---|---|---|---|---|---|
| 1,004,172 | A | * | 9/1911 | Johnson | 42/65 |
| 3,996,686 | A | * | 12/1976 | Baker | 42/65 |
| 4,128,957 | A | * | 12/1978 | Lee | 42/65 |
| 4,383,383 | A | * | 5/1983 | Landry | 42/67 |
| 4,437,250 | A | * | 3/1984 | Beretta | 42/59 |
| 4,577,429 | A | * | 3/1986 | Waiser | 42/59 |
| 4,641,449 | A | * | 2/1987 | Kapland et al. | 42/65 |
| 4,918,850 | A | * | 4/1990 | Rick | 42/59 |
| 5,548,914 | A | * | 8/1996 | Anderson | 42/66 |
| 6,016,736 | A | * | 1/2000 | Ghisoni | 89/157 |
| 6,286,241 | B1 | | 9/2001 | Constant et al. | |
| 6,286,242 | B1 | | 9/2001 | Klebes | |
| 6,321,478 | B1 | | 11/2001 | Klebes | |
| 6,345,461 | B1 | | 2/2002 | Constant et al. | |
| 6,345,462 | B1 | | 2/2002 | Mikuta et al. | |
| 6,357,157 | B1 | | 3/2002 | Constant et al. | |
| 6,360,468 | B1 | | 3/2002 | Constant et al. | |
| 6,360,469 | B1 | | 3/2002 | Mikuta et al. | |
| 6,360,470 | B1 | | 3/2002 | Constant et al. | |
| 6,370,806 | B1 | | 4/2002 | Klebes et al. | |

FOREIGN PATENT DOCUMENTS

| | | | |
|---|---|---|---|
| FR | 2586796 | * | 3/1987 |
| GB | 2555 | * | 2/1884 |

* cited by examiner

*Primary Examiner*—Michael J. Carone
*Assistant Examiner*—Troy Chambers
(74) *Attorney, Agent, or Firm*—McCormick, Paulding & Huber LLP

(57) ABSTRACT

A revolver includes a cylinder pivotally attached within an opening of a frame. The cylinder has a plurality of firing chambers sized to receive electrically fired cartridges. Each firing chamber is indexable to a carry-up position. A firing mechanism includes a trigger to actuate the firing mechanism from a recovered position to a fired position. A hand is attached to the trigger and engages the cylinder to index the chambers to their carry-up positions during actuation of the firing mechanism. A hammer is pivotally attached to the frame. A latch mechanism is pivotally attached to the frame wherein the latch mechanism engages the hammer in a set position during actuation of the firing mechanism. When the chambers reach their carry-up positions, the latch releases the hammer from the set position to displace the firing mechanism to the fired position to fire the revolver.

17 Claims, 11 Drawing Sheets

ELECTRONICALLY FIRED REVOLVER UTILIZING A LATCH MECHANISM BETWEEN TRIGGER AND HAMMER TO IMPLEMENT FIRING

CROSS REFERENCE TO RELATED APPLICATIONS

Some of the material disclosed herein is disclosed and claimed in the following pending U.S. patent application Ser. No. 09/616722, filed Jul. 14, 2000, entitled "AN ELECTRONICALLY FIRED REVOLVER UTILIZING PERCUSSIVELY ACTUATED CARTRIDGES", which is hereby incorporated by reference as part of the present disclosure.

FIELD OF THE INVENTION

The present invention relates to firearms. More specifically, the present invention relates to electronically fired revolvers in which a latch mechanism is incorporated to release the hammer at a desired point in trigger motion after the cylinder has carried up.

BACKGROUND OF THE INVENTION

Revolvers have been produced for over a century and, although continuous efforts have led to improvements in safety, manufacturing, and operation of revolvers, many components in their firing mechanism have remained relatively unchanged in function and design. Notably, the mechanical linkage between trigger, hammer and cylinder, i.e., the firing mechanism, still utilizes a basic design that requires direct engagement between the trigger and hammer in order to cock and fire the revolver.

In a conventional revolver a relatively large amount of force must be exerted on the trigger and main spring in order to load the hammer with enough potential energy to reliably discharge the cartridge. The relatively large force causes inherent problems in accurately aiming the firearm. This is especially problematic in double action (DA) revolvers, where the cylinder must be fully rotated, and the hammer must be cocked and fired in a single motion of the trigger.

Additionally, in double action revolvers, it is often difficult for an operator to discern the letoff point in the trigger movement, i.e., the point at which the movement of the trigger fully cocks the hammer and further trigger movement will release the hammer for firing. Moreover, the letoff point in a conventional firing mechanism varies greatly with tolerances and wear of the various mating surfaces involved in the linkage of the firing mechanism.

More recently, electronics have been incorporated into firearms to further improve the cost, manufacturability, and performance of the firearms. One such example of an electronic revolver is disclosed in the above referenced U.S. patent application Ser. No. 09/616,722 ('722).

Referring to FIGS. 1 and 2, an embodiment of a revolver in accordance with the '722 application is shown generally at 10. The '722 application describes a revolver 10 having an electronic firing apparatus adapted to produce a firing signal. The revolver 10 includes a frame 12, a cylinder 14 having a firing chamber to receive a cartridge therein. The revolver also includes a barrel with a firing axis attached to the frame in alignment with the firing chamber and a trigger 16. A linearly displaceable firing probe 18 (as opposed to a conventional firing pin) is disposed within the frame 12 for linear reciprocal movement from a probe recovered position, wherein the firing probe 18 is retracted away from the cartridge, to a probe contacting position, wherein the firing probe 18 is disposed forwardly in contact with the cartridge (not shown). Actuation of the trigger 16 causes the firing probe 18 to move from the probe recovered position to the probe contacting position only when an electronic security apparatus (not shown) determines the revolver 10 is in a firing mode and the operator is an authorized operator.

An embodiment of a firing mechanism in accordance with the '722 application is shown generally at 20. The firing mechanism 20 includes the trigger 16, a hammer 22, a sear 24, a transfer bar 25, a hand 26, a rebound 28, a main spring (or rebound spring) 30, a stirrup 32, and a link 34. A trigger lever 36 is coupled between the trigger 16 and the rebound 28 to compress the main spring 30.

The hand (or ratchet arm) 26 is connected to the trigger 16 via hand pin 27, and has a configuration and function known well in the industry to index the cylinder 14 as the trigger 16 is pulled. During actuation of the firing mechanism 20, it is important that the hand 26 fully index and align the cylinder 14 with the firing axis of the revolver 10 just before the trigger 16 reaches the letoff point and releases the hammer 22 for firing. For purposes of this application this indexing and alignment is defined as the "carry-up" of the cylinder. In this regards, the tolerences of the hand pin 27 and the length of the hand 26 are critical for achieving carry-up.

Movement of the entire firing mechanism 20 is governed predominantly by three pivot pins which mount and secure the firing mechanism 20 in a cavity 31 of the frame 12. The stirrup 32 is pivotally mounted by a stirrup pin 38, the hammer 22 is pivotally mounted by a hammer pin 42, and the trigger is pivotally mounted by a trigger pin 40. The frame 12 has a contoured cam surface 44 located and shaped within the cavity 31 to guide the transfer bar 25 during early stages of firing mechanism 20 actuation described below.

The trigger 16 includes a trigger post 46 with a flat upper surface 48 which bears generally vertically against the distal end of the sear 24 during early stages of firing mechanism 20 actuation. The trigger post 46 defines a trigger pocket 50 that receives the transfer bar 25 throughout the entire cycle of firing mechanism 20 actuation. The lower end of the trigger pocket 50 forms a relatively sharp let-off apex 52 designed to engage a foot 54 of the hammer 22 during the later stages of firing mechanism 20 actuation.

FIG. 1 shows the firing mechanism 20 in its "recovered position", i.e., the normal rest position that the components of the firing mechanism 20 return (or recover) to when the revolver 10 is fired and the trigger 16 is released. FIG. 2 shows the relative position of the various components of the firing mechanism 20 at its let-off point, i.e., the point at which the hammer 22 is fully cocked. and further trigger 16 movement will release the hammer 22 from the trigger 16 for firing.

Problematically, as illustrated in FIG. 2, minor deviations in the trigger to hammer linkage will greatly affect the letoff point. That is, small tolerance or wear variations in the surfaces at the trigger's letoff apex 52 and the hammer's foot 54 can result in large angular deviations 56 in trigger position at the letoff point. Moreover, the tolerances and wear of the trigger pin 40 and hammer pin 42 also significantly contribute to the angular deviation 56.

Just as critically, the tolerances of the angular deviation 56 also affect the carry-up of the cylinder, i.e., indexing and alignment of the cylinder chamber with the firing axis, which must be accomplished just before the letoff point. This is because the hammer and hand are both directly engaged with the trigger. As a result, the carry-up is affected by both the trigger to hammer linkage as well as the trigger to hand linkage. That is, in addition to the angular deviation 56 caused from tolerances of the trigger to hammer linkage, the tolerances of the length of the hand 26 as well as the tolerances in the hand pin 27, i.e., the trigger to hand linkage, further exacerbate the problem of accurately achieving carryup. Moreover, because the hammer 22 and hand 26 are each directly linked to the trigger, 16, there is no way to separate the constraints of the trigger to hammer linkage from the trigger to hand linkage, therefore making manufacturing more difficult.

Based on the foregoing, it is the general object of the present invention to provide an electronically fired revolver that overcomes the problems and drawbacks associated with prior art revolvers.

SUMMARY OF THE INVENTION

The present invention offers advantages and alternatives over the prior art by providing a revolver having a latch mechanism between the hammer and trigger, such that the hammer does not directly engaged with the trigger during actuation of the firing mechanism. Accordingly, the linkage between the hammer and latch is separate from the linkage between the trigger and hand. As a result, the tolerance build up in each linkage can be treated as two parallel designs rather than being stacked in series upon one another, therefore simplifying production manufacture of the firing mechanism.

These and other advantages are accomplished in an exemplary embodiment of the invention by providing a revolver configured to discharge electrically fired cartridges. The revolver includes a frame, and a barrel with a firing axis attached to the frame, a cylinder and a firing mechanism. The cylinder is pivotally attached within an opening of the frame and has a plurality of firing chambers sized to receive the electrically fired cartridges. Each firing chamber is indexable to a carry-up position wherein the chamber is in alignment with the firing axis. The firing mechanism includes a trigger, a hand, a hammer and a latch mechanism. The trigger is pivotally attached to the frame to actuate the firing mechanism from a recovered position to a fired position. The hand is pivotally attached to the trigger such that the hand engages the cylinder to index the chambers to their carry-up positions during actuation of the firing mechanism. The hammer is pivotally attached to the frame. The latch mechanism is pivotally attached to the frame wherein the latch mechanism engages the hammer in a set position during actuation of the firing mechanism. When the chambers reach their carry-up positions, the latch releases the hammer from the set position to displace the firing mechanism to the fired position to fire the revolver.

In an alternative embodiment of the invention, the revolver includes the hammer having a forwardly extending hook portion and the latch mechanism having a rearwardly extending ramp. In the set position, the hook of the hammer engages the ramp of the latch mechanism to prevent the hammer from rotating.

In another alternative embodiment of the invention the revolver includes the hammer having a hammer foot at its lower distal end. A rebound is slidably mounted to the frame and the rebound has a hammer stop protruding upwardly therefrom. When the firing mechanism returns to the recovered position the rebound slides under the hammer such that the hammer stop rotates the hammer foot to disengage the latch mechanism from the hammer.

DETAILED DESCRIPTION OF THE PREFERRED EMBODIMENTS

Figure 3:
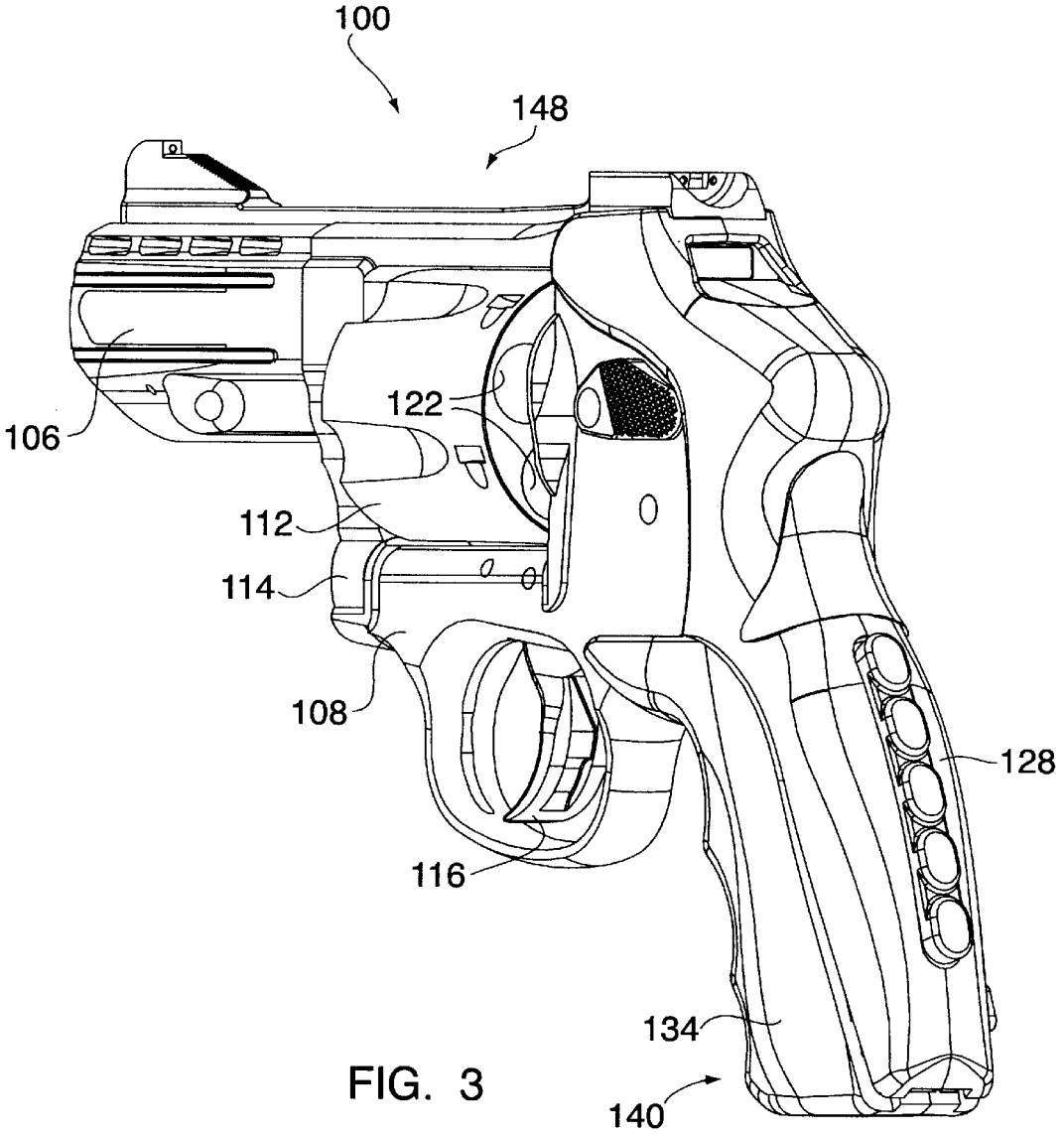
FIG. 3 is a rear perspective if a revolver in accordance with the present invention.
Figure 4:
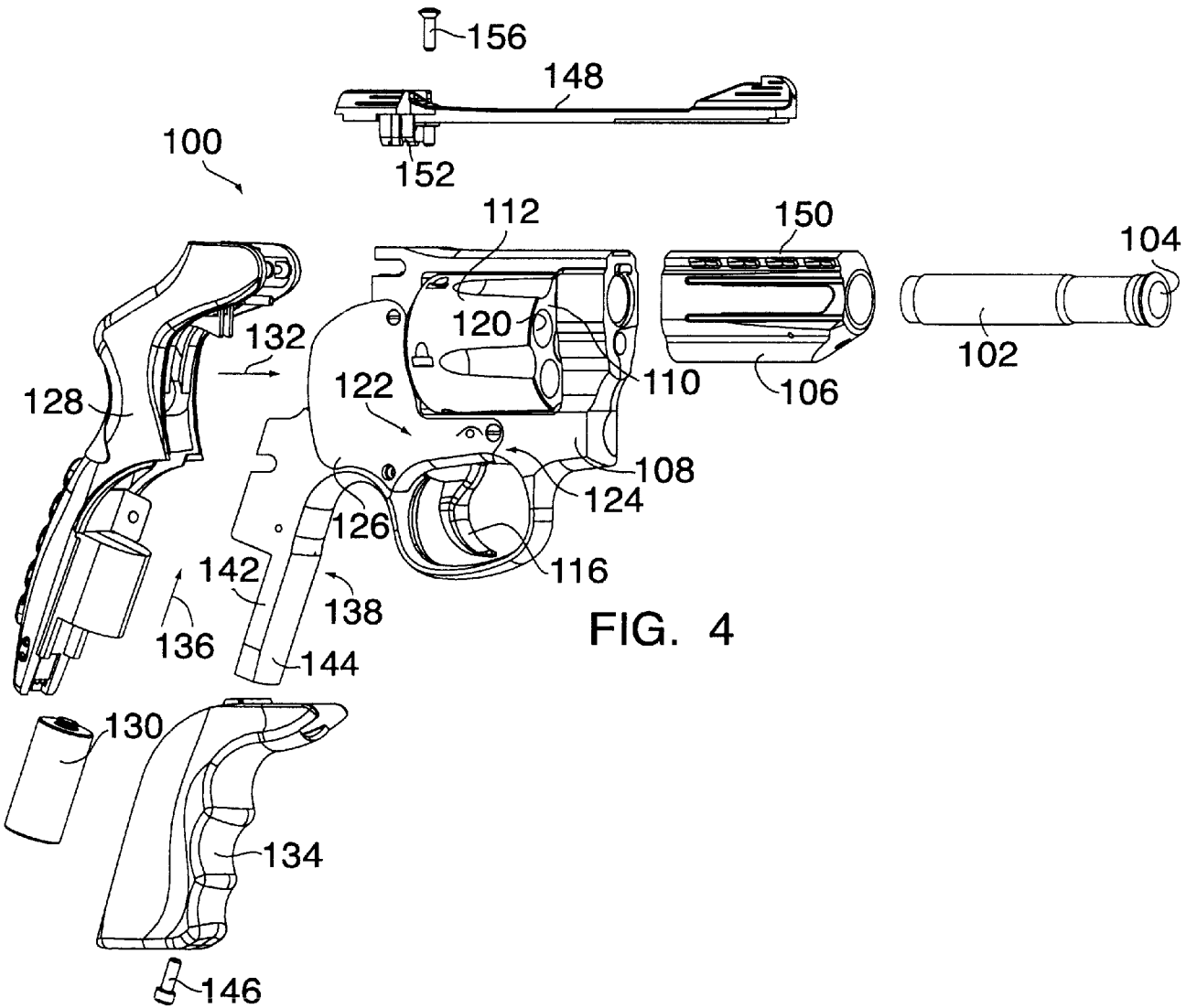
FIG. 4 is an exploded perspective view of the revolver of FIG. 1.

Referring to FIGS. 3 and 4, an exemplary embodiment of a revolver in accordance with the present invention is shown generally at 100. The revolver 100 with a muzzle end shown to the left in FIG. 3, and a rear end to the right, includes a barrel 102 having a bore 104 and received in a barrel shroud 106 mounted on a frame 108. The frame 108 has a generally rectangular opening 110 therethrough which receives a cylinder 112 rotationally hung on a yolk 114 that swings at a right angle to the frame 108. A spring loaded bolt 115 (best seen in FIGS. 9 and 10) slides forward to a locked position to prevent the revolver 100 from firing when the cylinder 112 is not fully engaged within the rectangular opening 110. A trigger 116 is pivotally supported on the frame 108 by a pivot pin, while a hand 118 (seen in FIG. 5) is pivotally attached to the trigger 116 and configured to index a plurality of cylinder chambers 120 into axial alignment with the bore 104. The cylinder chambers 120 are sized to receive electronically fired cartridges (not shown). The right side of the frame 108 defines an inner cavity 122 which mounts and protects an arrangement of mechanical components which cock and fire the revolver 100, collectively referred to as a firing mechanism 124. Conventional screws are used to attach a side plate 126 to the frame 108 to enclose the cavity 122 and prevent entry of debris into the cavity 122.

Figure 1:
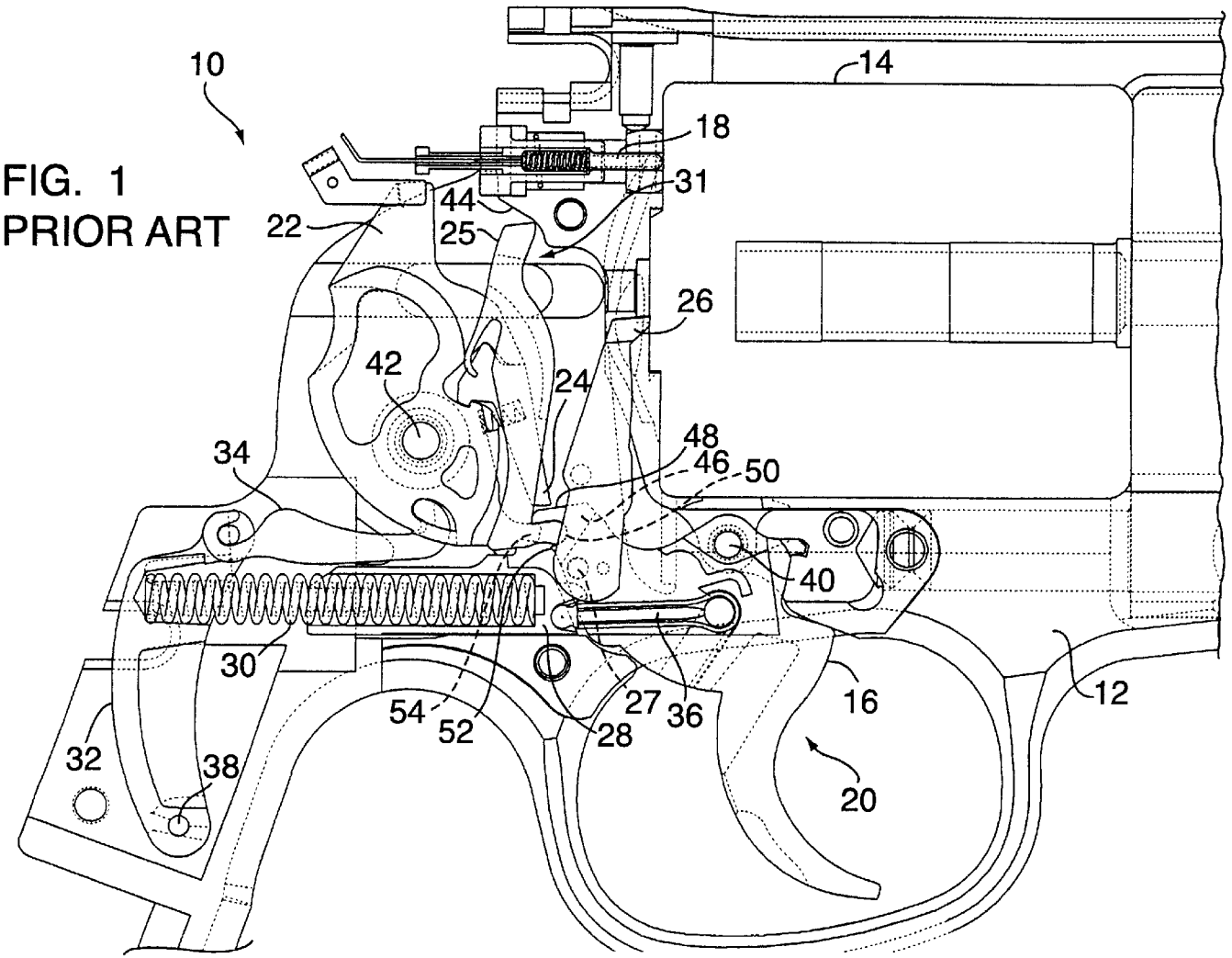
FIG. 1 PRIOR ART
FIG. 1 is a perspective view of a prior art firing mechanism in the recovered position.
Figure 2:
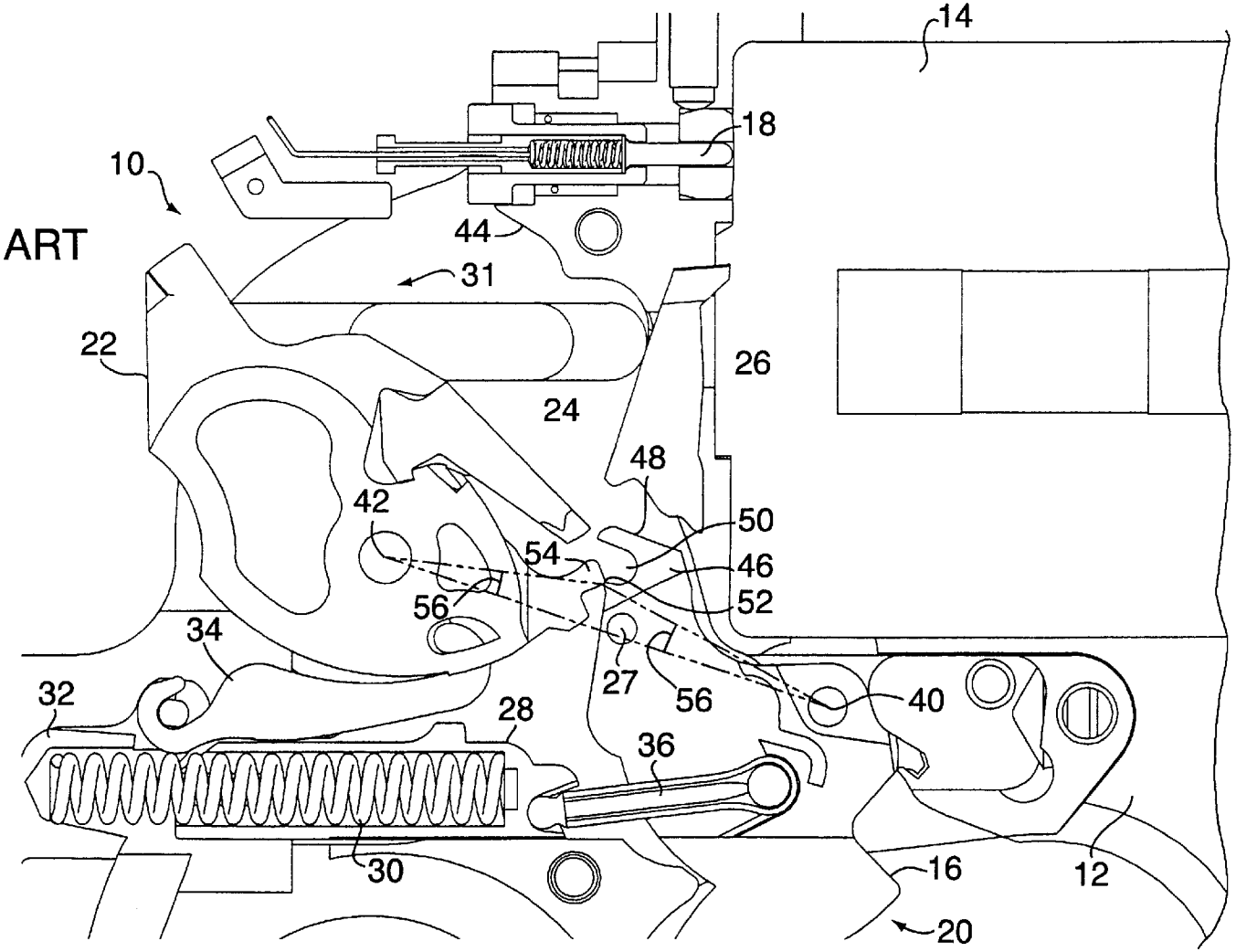
FIG. 2 PRIOR ART
FIG. 2 is a perspective view of the prior art firing mechanism of FIG. 1 in the let-off position.

All subsequent references to left, right, rearward and forward directions are to be interpreted hereafter according to the coordinates established above. Therefore, as the revolver 100 is held in its sighting position, the left side of the revolver 100 is that shown in FIG. 1, and the right side shown as disassembled in FIG. 2.

The revolver 100 of the present invention includes many mechanical components having functions understood well in the industry. However, as the revolver 100 is configured to discharge electrically-fired cartridges, such as developed by Remington Arms Company and referred to as the Conductive Primer Mix described in U.S. Pat. No. 5,646,367, many of the well-known mechanical components have been modified, eliminated, or replaced as needed.

A backstrap module 128 is configured to contain and protect most of the electronics, including a battery 130, and the module 128 mates with the rear end of the revolver 100 in a direction indicated by arrow 132. An ergonomically-designed finger grip attachment 134 is moved in a direction generally indicated by arrow 136 to engage the backstrap module 128 and a frame post 138, thereby forming a handgrip 140 which depends from the rear of the frame 108. The frame post 138 has parallel, opposed side surfaces 142 and a contoured front surface 144 which are contacted by complimentary surfaces of the finger grip attachment 134 during assembly of the revolver 100. Once the backstrap module 128 and finger grip attachment 134 are positioned onto the frame 108, a lower mount screw 146 is inserted through the finger grip attachment 134 to secure the handgrip 140.

A sight assembly 148 is received within a top edge 150 of the frame 108 and the barrel shroud 102, and includes a lower housing 152. During assembly, the lower housing 152 is pressed downwardly into the frame 108 and secured with a sight assembly mount screw 156.

Referring to FIGS. 5–8, the firing mechanism 124 includes the trigger 116, a hammer 160, a transfer bar 162, the hand 118, a latch mechanism 163 a rebound 164, a main spring (or rebound spring) 166, a stirrup 168, and a link 170. A trigger lever 172 is coupled between the trigger 116 and the rebound 164 to compress the main spring 166 during actuation of the firing mechanism 124.

The hand (or ratchet arm) 118 is a generally leg shaped structure having a foot shaped upper portion 176. The foot shaped upper portion 176 of the hand 118 has a toe (forward) section 180 and a heal (rearward) section 182. The lower portion of the hand 118 is connected to the trigger 116 via hand pin 174. The top surface of the toe section 180 engages a plurality of cylinder ratchets 184 in a pawl-and-ratchet-like movement to index the cylinder 112 as the trigger 116 is pulled rearward. When the cylinder is indexed to its carry-up position, a pivotally mounted spring loaded cylinder stop 186 is urged into one of a plurality of cylinder notches 188 to lock the chamber 120 of the cylinder 112 into axial alignment with the bore 104. As will be described in greater detail hereinafter, the top surface of the heal section 182 of hand 118 engages the latch 163 to release the hammer 160 for firing just after the cylinder 112 reaches its carry-up position.

Movement of the entire firing mechanism 124 is governed predominantly by four pivot pins which mount and secure the firing mechanism 124 in the inner cavity 122 of the frame 108. The stirrup 168 is pivotally mounted by a stirrup pin 190, the hammer 160 is pivotally mounted by a hammer pin 192, the trigger 116 is pivotally mounted by a trigger pin 194 and the latch 163 is pivotally mounted by a latch pin 196.

The trigger 116 includes a rearwardly extending generally tail shaped trigger post 198, which has defined therein a trigger pocket 200 that pivotally engages the transfer bar 162 throughout the entire cycle of firing mechanism 124 actuation. The upper distal end 202 of the transfer bar 162 forms a U shaped fork which straddles a linearly displaceable firing probe 204 when the transfer bare 162 is fully guided up by the pivotal movement of the trigger 116. Upon firing, the hammer 160 forces the upper distal end 202 of the transfer bar 162 against a non-conductive actuator bushing 206 to release the probe 204 into conductive contact with a cartridge 208 in the cylinder chamber 120.

The trigger lever 172 has a forward end 210 pivotally attached to the trigger 116, and a ball 212 at its rear end which is received in a socket 214 of the rebound 164. The rebound 164 has an underside and lateral outer surfaces which are generally flat to allow the rebound 164 to slide freely within the cavity 122 of the frame 108 during actuation of the firing mechanism 124. A hammer stop 216 extends upwardly from the top side of the rebound 164 to engage a foot portion 218 of the hammer 160 during recovery of the firing mechanism 124. The rear end of the rebound 164 defines a blind bore 220 which receives the front end of the main spring 166. The rear end of the main spring 166 is captured within the stirrup 168. The link 170 has a rearward hook 222 pivotally engaging the upper end of the stirrup 168, and a forward hook 224 pivotally engaged with a through hole 226 defined in the lower end of the hammer 160. The function of the link is to transfer the energy of the main spring 166 to the hammer 160 during actuation of the firing mechanism 124.

The latch 163 is approximately L shaped and includes a generally horizontally extending upper leg 228 and a generally vertically extending lower leg 230. The distal end of the lower leg 230 terminates in a rearwardly extending ramp 232, which is sized to mate with a forwardly extending hook portion 234 of the hammer 160 during actuation of the firing mechanism 124.

Figure 5:
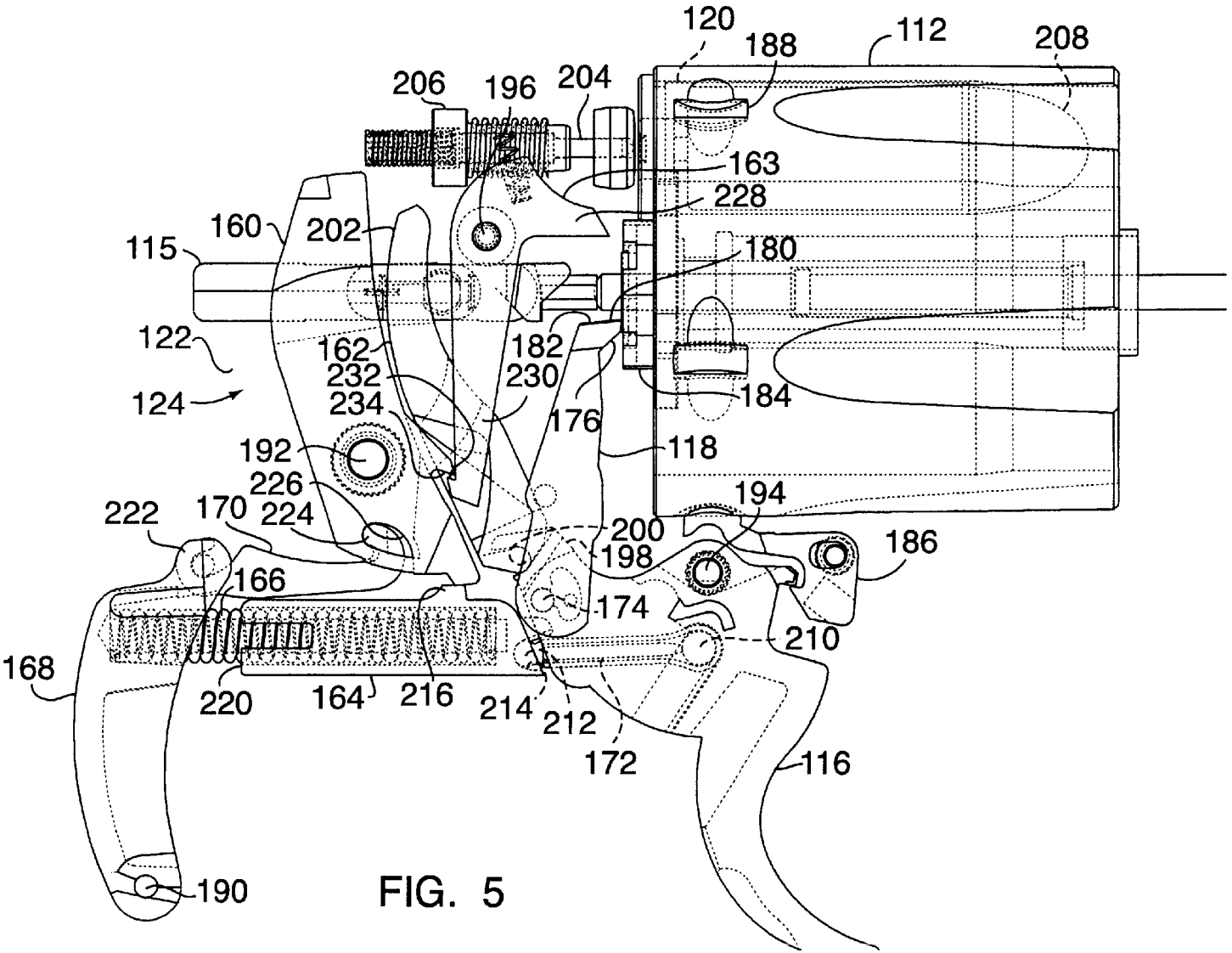
FIG. 5 is perspective view of the firing mechanism of the revolver of FIG. 1 in the recovered position.

FIGS. 5 through 8 illustrate four distinct phases of firing mechanism 124 actuation, i.e., "recovered", "set", "carry-up" and "fired", respectively. FIG. 5 shows the firing mechanism in its "recovered position", i.e., the normal rest position that the components of the firing mechanism 20 return (or recover) to when the revolver 10 is fired and the trigger 16 is released. In the recovered position the trigger 116 is in its release position as it is rotated fully forward. Accordingly, the foot 218 of the hammer 160 is supported by the hammer stop 216 of the rebound 164, which rotates the hammer 160 fully counterclockwise to lift and separate the hammer hook portion 234 from the latch ramp portion 232. The engagement of the foot 218 to the stop 216 provides a safe condition insuring that the hammer 160 cannot engage the igniter probe 204 unless the trigger is pulled nearly all the way back even if the latch mechanism 118 fails to engage the hammer 160 properly.

Figure 6:
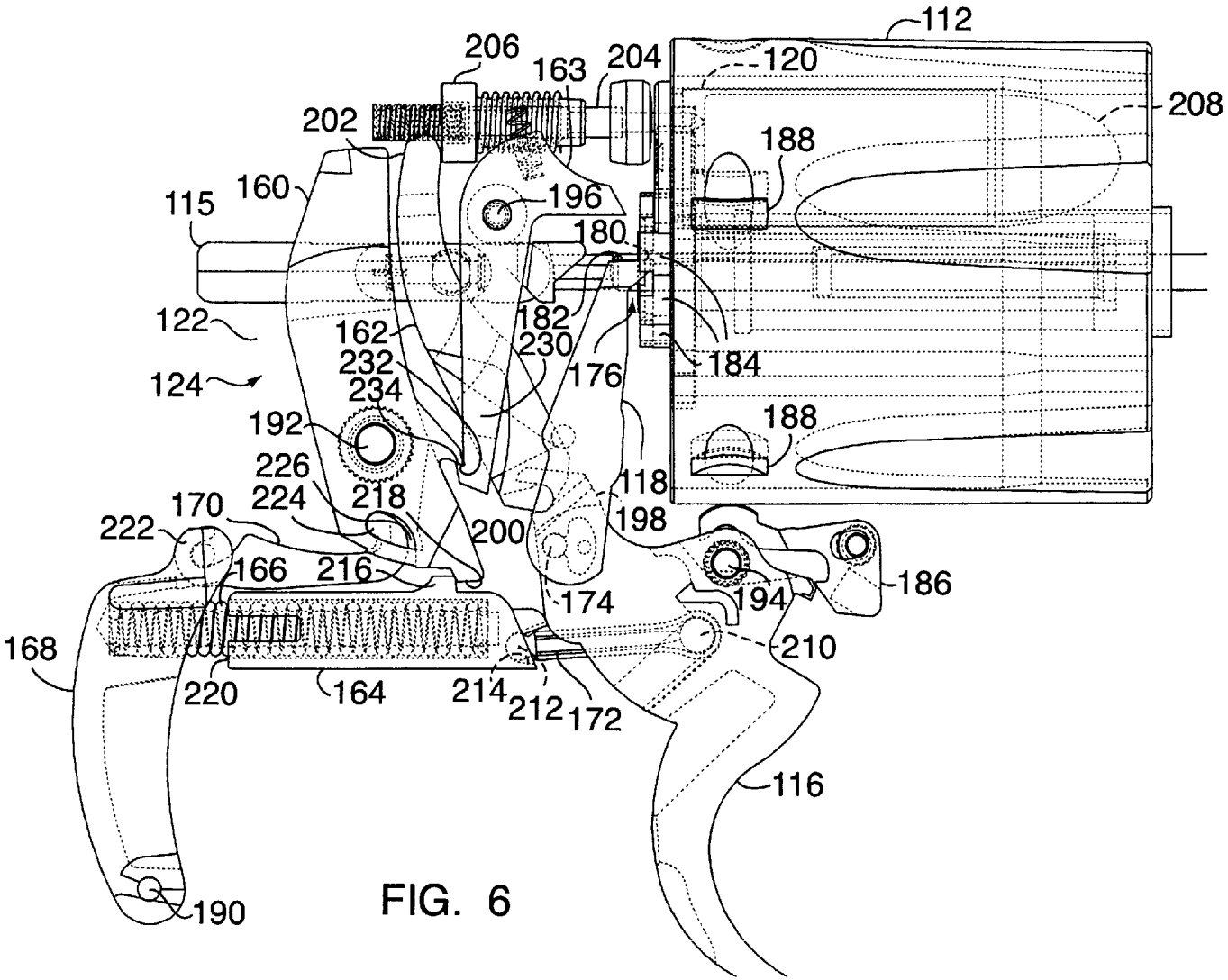
FIG. 6 is perspective view of the firing mechanism of the revolver of FIG. 1 in the set position.

FIG. 6 reveals the relative position of the firing mechanism 124 components at the set position. In the set position, the trigger 116 is pulled clockwise, and the hammer stop 216 of the rebound 164 slides rearwardly out from underneath the hammer's foot 218. In this position, the hammer 160 rotates clockwise until the hook 234 of the hammer 160 engages the ramp 232 of the latch 163. At this point the hammer is essentially cocked, and any further relative movement of the hook 234 and ramp 232 will release the hammer 234 and fire the revolver 100. Additionally, the toe section 182 of the hand 118 has indexed the cylinder 112 part way though its rotation, but the carry-up position has not yet been achieved.

Figure 7:
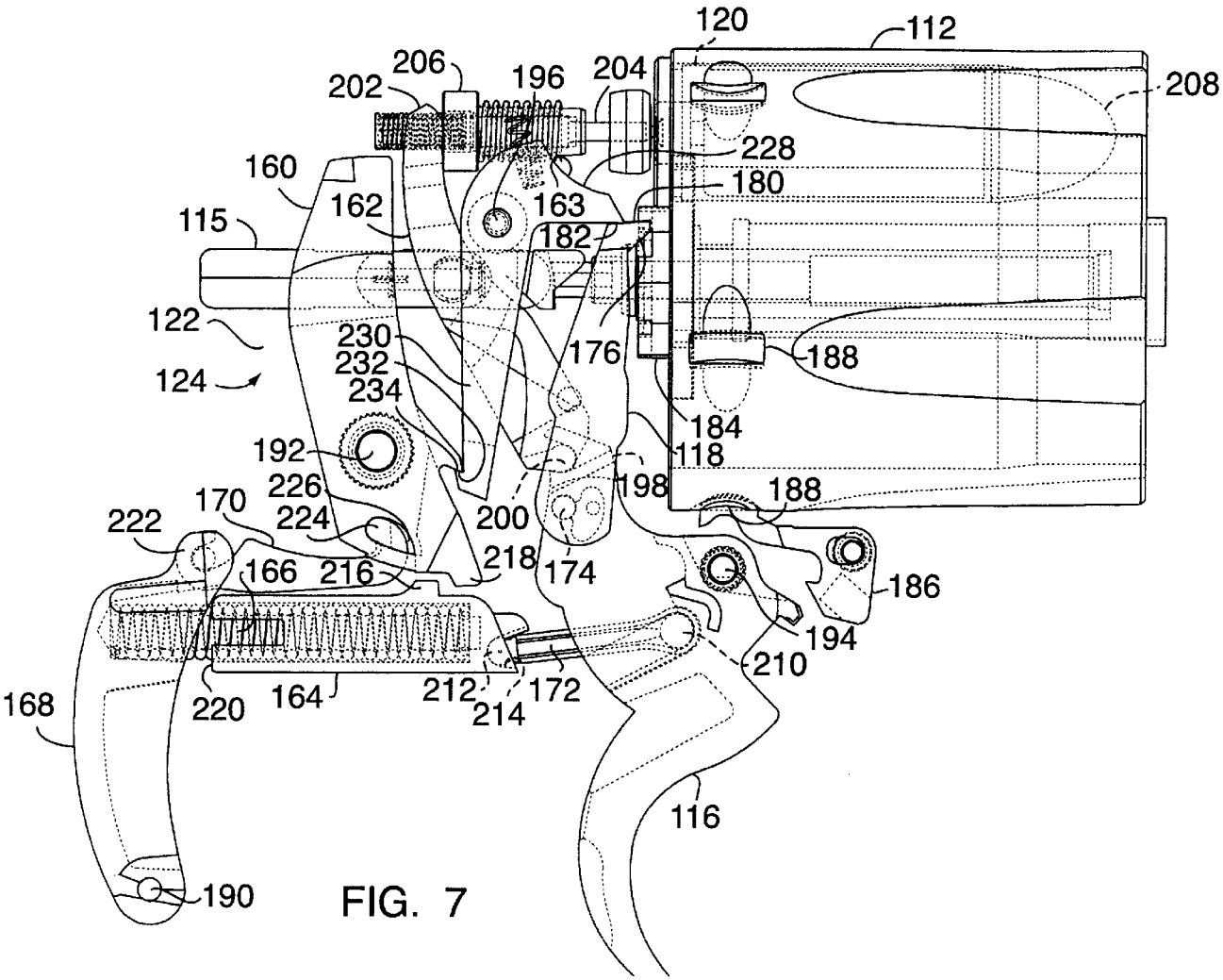
FIG. 7 is perspective view of the firing mechanism of the revolver of FIG. 1 with a cylinder chamber in the carry-up position.

FIG. 7 shows the carry-up position of the firing mechanism 124. As trigger 116 is pulled from the set position to the carry-up position, the rebound and main spring are compressed rearward to further separate the rebound's 164 hammer stop 216 from the foot 218 of the hammer 160. The transfer bar 162 has been extended such that its U shaped upper distal end 202 straddles the firing (or igniter) probe 204.

Moreover, the hand 118 has completed rotation of the cylinder 112 to achieve carry-up, i.e., axial alignment of the cylinder chamber 120 with the bore 104 of the revolver 100. At carry-up, the heal 182 of the hand 118 just abuts the underside of the upper leg 228 of the latch 163. The cylinder 112 is locked into alignment by the pivotal engagement of the cylinder stop 186 with the cylinder notch 188. It is important to note that during movement from the set position to the carry-up position, the hammer 160 and latch 163 remain fixed relative to each other. That is, the hammer's hook portion 234 remains engaged with the latches ramp 232.

In contrast to prior art double action revolvers, reaching the carry-up position has a distinct and discernable feel to the operator when the trigger is pulled. This is because at carry-up, the operator can feel the point at which the heal 182 of the hand 118 makes contact with underside of the upper leg 228 of the latch 163. Accordingly, the discernable feel of reaching the carry-up position puts an operator on notice that the heaviest work on the trigger 116 is done, and the operator can concentrate on carefully aiming the revolver 100 during the final squeeze of the trigger 116.

Figure 8:
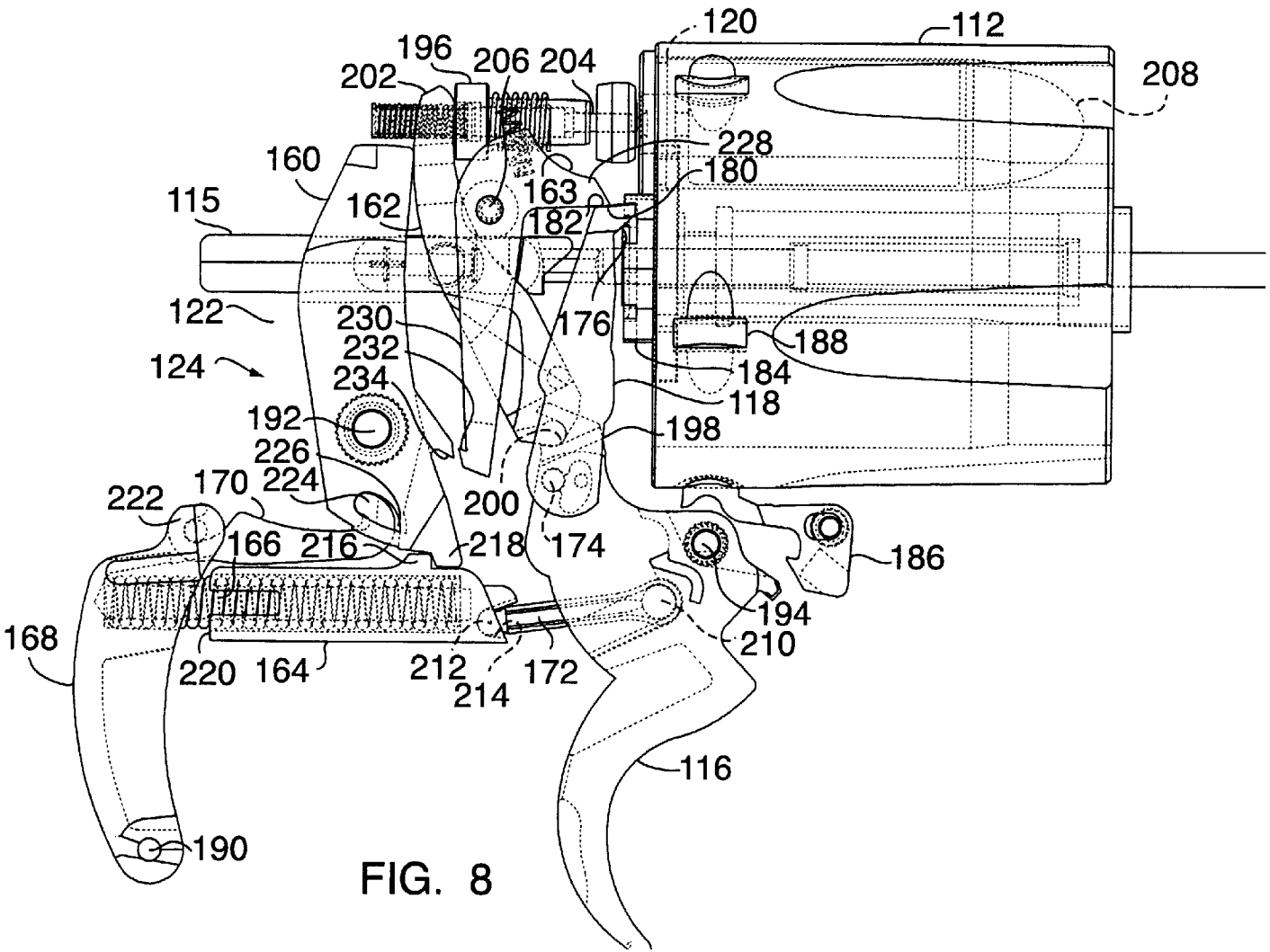
FIG. 8 is perspective view of the firing mechanism of the revolver of FIG. 1 in the fired position.

FIG. 8 shows the fired position of the revolver's firing mechanism 124. As the trigger 116 is pulled the relatively small distance from the carry-up position to the fired position, the heal 182 of the hand 118 urges the latch 163 in a counterclockwise direction until the ramp 232 of the latch 163 and the hook 234 of the hammer 160 separate. Accordingly, the hammer 160 is rapidly pivoted clockwise by its linkage via the link 170 and stirrup 168 to the main spring 166. The hammer 160 drives the transfer bar 162 into the actuator bushing 206, which releases the firing probe 204 into electrical contact with the cartridge 208 to fire the revolver 100. Though the forward section 180 of the upper portion 176 of the hand 118 has been described as a toe and the rearward section 182 has been described as a heal, it is apparent that the forward and rearward sections may have other general shapes as well which perform the functions of engaging the cylinder ratches and latch simultaneously.

Once fired, the trigger 116 is then released by the operator and the main spring 166 forces the rebound 164 forwardly again. Accordingly, the hammer stop 216 re-engages with the hammer foot 218 to pivot the hammer 160 counterclockwise as the stop 216 slides under the hammer foot 218 as shown in the recovered position.

Just as in the prior art, the carry-up position of the present invention is also the let-off point of the firing mechanism. However, unlike the prior art, small tolerance deviations or wear changes in the geometry between the ramp 232 and the hook 234 do not have a critical effect on the position of the let-off point.

Just as advantageously, the linkage between the hammer 160 and latch 163 is separate from the linkage between the trigger 116 and hand 118. This is because, in distinct contrast to the prior art, the hammer does not directly engaged with the trigger.

As a result, the carry-up is affected primarily by the trigger 116 to hand 118 linkage, and the let-off point is affected primarily by the hammer 160 to latch 163 linkage. That is, the constraints of the trigger to hammer linkage are separated from the constraints of the trigger to hand linkage. Accordingly, the tolerance build up in each linkage can be treated as two parallel designs rather than being stacked in series upon one another, therefore simplifying production manufacture of the firing mechanism.

Figure 9:
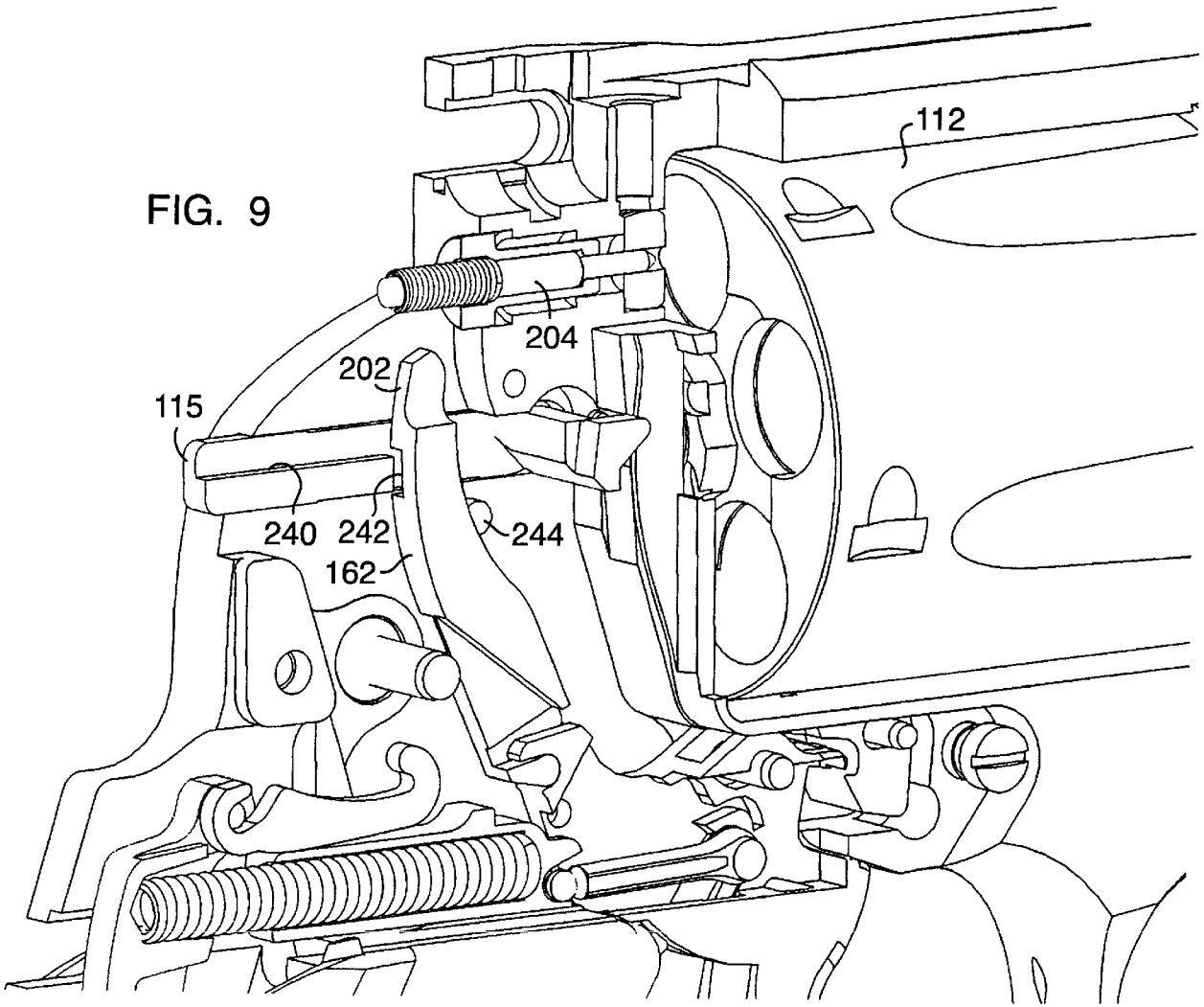
FIG. 9 is a perspective view of the firing mechanism of FIG. 1 showing the spring loaded bolt and guide slot of the transfer bar with the cylinder in the closed position.
Figure 10:
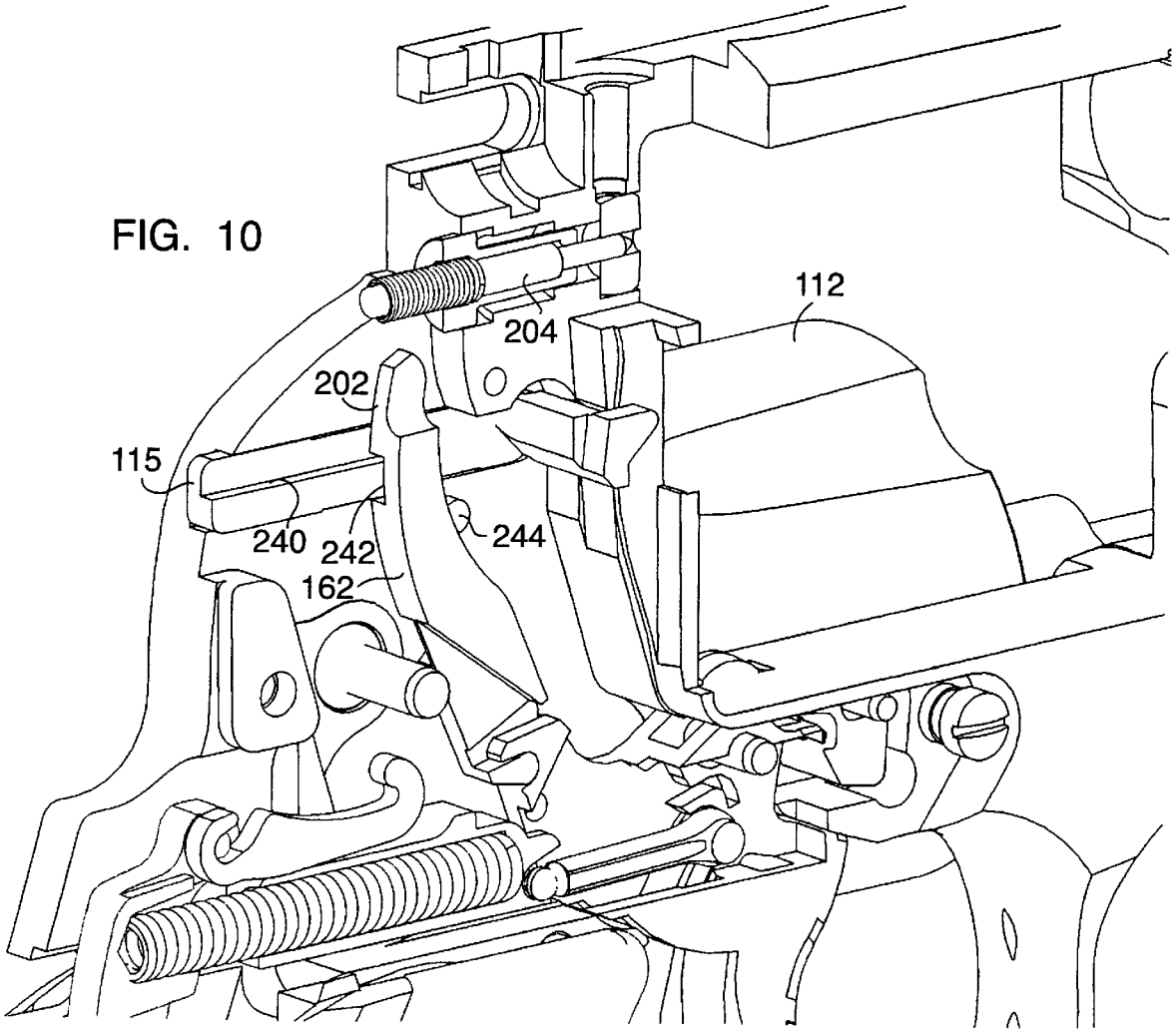
FIG. 10 is a perspective view of the firing mechanism of FIG. 1 showing the spring loaded bolt and guide slot of the transfer bar with the cylinder in the open position.

Referring to FIGS. 9–10, the spring loaded bolt 115 includes a rectangular rib 240 sized to slidably fit into a slot 242 on the transfer bar 202. The frame 108 defines the generally rectangular opening 110, which receives the cylinder 112. The cylinder 112 is rotationally hung on the yolk 114 and swings from a closed position (best seen in FIG. 9. to an open position (best seen in FIG. 10) at a right angle to the frame 108. As is well known in the art, the cylinder is locked into the closed position by a center spring urging a center pin into an alignment hole in the frame (not shown).

When the cylinder 112 is fully locked into the closed position, the bolt 115 is biased rearward by the cylinder 112 center pin such that the rib 240 does not engage the slot 242 on the transfer bar 162. Alternatively, when the cylinder is not locked into its closed position, a bolt spring (not shown) biases the bolt 115 forward, slidably engaging the bolt rib 240 within the slot 242 to lock the transfer bar 162 and trigger 116 in place. This safety feature prevents the revolver 100 from being inadvertently fired when the cylinder 112 is not completely closed, i.e., when the cylinder looks closed to the naked eye, but the center pin is not actually protruding into the alignment hole.

Figure 11:
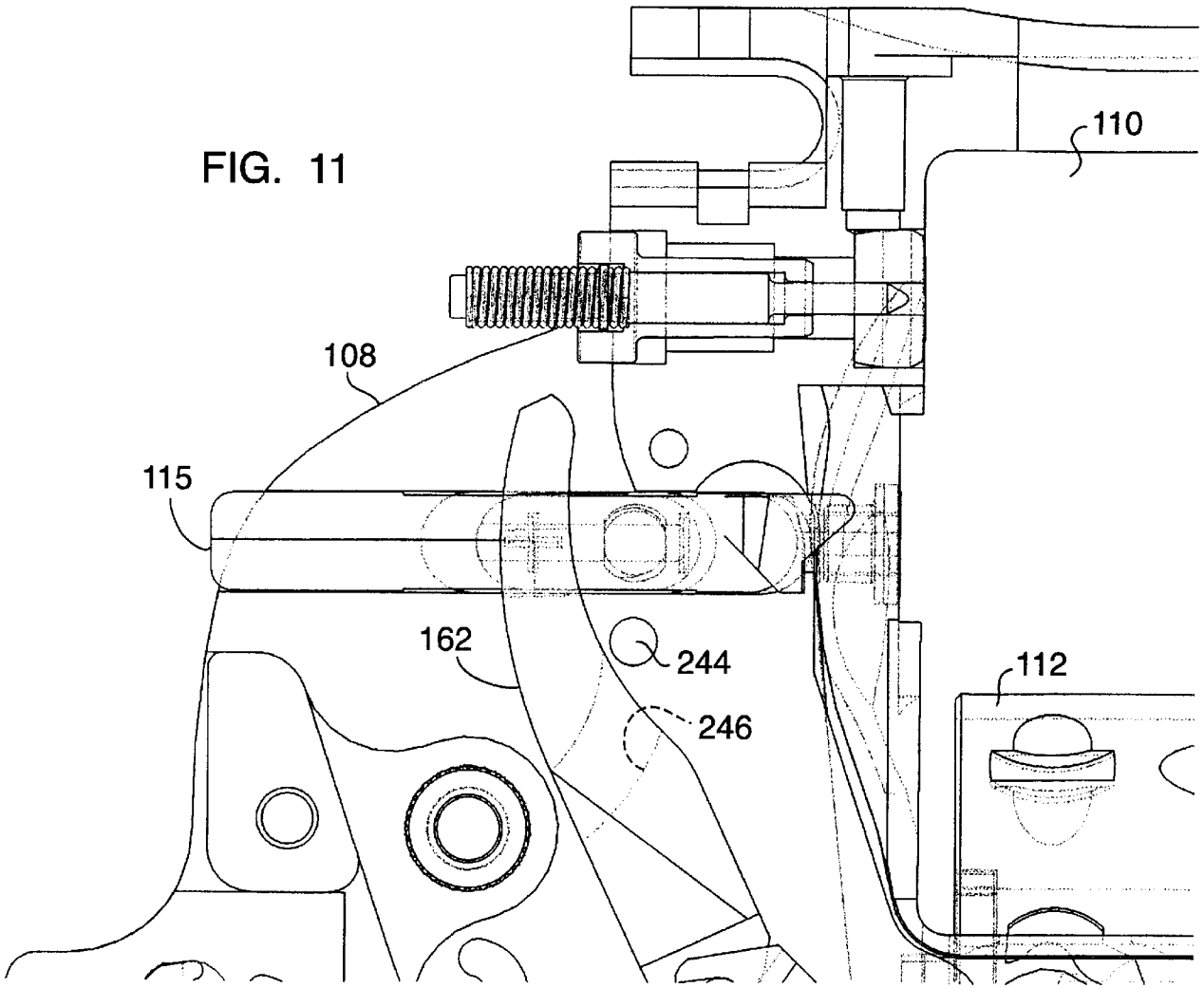
FIG. 11 is a perspective side view of the firing mechanism of FIG. 1 showing the spring loaded bolt and guide slot of the transfer bar with the cylinder in the open position.

Referring to FIG. 11, the forward travel of the transfer bar 162 is limited by a transfer bar limit pin 244, while the rearward travel of the transfer bar 162 is limited by the hammer 160 (not shown). Though the limit pin is cylindrical in shape, it is apparent that the limit pin 244 can be any shaped protrusion extending laterally from the frame 108 which interferes with the forward pivotal movement of the transfer bar 162. The limit pin 244 is position on the frame to limit the forward movement of the transfer bar 162 such that the bolt rib 240 remains sufficiently engaged within the transfer bar slot 242 whenever the cylinder 112 is in the open position. Additionally, when the cylinder is in the closed position, a curved guide slot 246 in the body of the transfer bar 162 is sized to allow the limit pin 244 to pass therethrough. The guide slot 246 enables the trigger 116 to move the transfer bar 162 upwardly without interference with the limit pin 244 when the cylinder 112 is closed and firing mechanism 124 is being actuated.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A revolver configured to discharge electrically fired cartridges, the revolver comprising:

a frame;

a barrel with a firing axis attached to the frame;

a cylinder pivotally attached within an opening of the frame and having a plurality of firing chambers sized to receive the electrically fired cartridges, each firing chamber being indexable to a carry-up position wherein the chamber is in alignment with the firing axis; and a firing mechanism including, a trigger attached to the frame to actuate the firing mechanism from a recovered position to a fired position, a hand engaged with the trigger wherein the hand engages the cylinder to index the chambers to their carry-up positions during actuation of the firing mechanism, a hammer pivotally attached to the frame, and a latch mechanism engaged with the frame wherein the latch mechanism engages the hammer and does not engage the trigger in a set position during actuation of the firing mechanism; and wherein when the chambers reach their carry-up positions, the latch releases the hammer from the set position to displace the firing mechanism to the fired position to fire the revolver.

2. The revolver of claim 1 wherein, when a cylinder of the plurality of cylinders is indexed to its carry-up position, the hand engages the latch mechanism to release the hammer from the set position.

3. The revolver of claim 2 comprising:

the hammer having a forwardly extending hook portion; and the latch mechanism having a rearwardly extending ramp;

wherein in the set position, the hook of the hammer engages the ramp of the latch mechanism to prevent the hammer from rotating.

4. The revolver of claim 3 comprising the latch mechanism having a generally L shape and including a generally horizontally extending upper leg and a generally vertically extending lower leg, the lower leg having a distal end terminating in the rearwardly extending ramp.

5. The revolver of claim 4 wherein the hand includes an upper portion comprising:

a forward section sized to engage a plurality of cylinder ratchets of the cylinder to index the cylinder chambers into their carry-up positions as the trigger is pulled rearward; and a rearward section sized to engage the upper leg of the latch mechanism to pivot the lower leg of the latch mechanism and disengage the ramp of the latch mechanism from the hook of the hammer when the cylinder chambers reach their carry-up positions.

6. The revolver of claim 1 comprising:

the hammer having a hammer foot at its lower distal end; and a rebound slidably mounted to the frame, the rebound having a hammer stop protruding upwardly therefrom;

wherein when the firing mechanism returns to the recovered position the rebound slides under the hammer such that the hammer stop rotates the hammer foot to disengage the latch mechanism from the hammer.

7. The revolver of claim 6 comprising:

a trigger lever coupling the rebound to the trigger;

a stirrup pivotally connected to the frame;

a link coupling the stirrup to the hammer; and a main spring having an end portion slidably received within a blind hole of the rebound and an opposing end portion captured within the stirrup;

wherein the link transfers energy from the main spring to the hammer when the trigger actuates the firing mechanism.

8. The revolver of claim 7 wherein when the trigger actuates the firing mechanism, the rebound slides rearwardly out from underneath the hammer's foot and the hammer rotates until the hammer engages the latch mechanism to reach the set position.

9. The revolver of claim 8 wherein the action of the hand engaging with the latch mechanism provides a distinct and discernable feel to an operator actuating the trigger.

10. The revolver of claim 1 comprising:

a firing probe disposed within the frame for linear reciprocal movement from a probe recovered position wherein the firing probe is retracted away from the cartridge, to a probe contacting position wherein the firing probe is disposed forwardly in contact with the cartridge; and wherein, when the latch mechanism releases the hammer from the set position, the hammer displaces the probe from the probe recovered position to the probe contacting position.

11. The revolver of claim 10 comprising:

a transfer bar pivotally engaged to the trigger; and an actuator bushing concentrically mounted on the firing probe;

wherein, when the latch mechanism releases the hammer from the set position, the hammer engages the transfer bar to drive the transfer bar against the actuator bushing to fire the revolver.

12. The revolver of claim 11 wherein the transfer bar has a U shaped upper distal end sized to straddle the firing probe when the transfer bar is fully guided upwardly by the pivotal movement of the trigger during actuation of the firing mechanism.

13. The revolver of claim 11 comprising:

the transfer bar having a slot extending therethrough; and a spring loaded bolt having a rib sized to slidably fit into the slot of the transfer bar.

14. The revolver of claim 13 comprising:

a yolk attached to the opening of the frame from which the cylinder is rotationally hung and swings from a closed position to an open position;

a center spring attached to the frame and urging a center pin into an alignment hole in the frame to lock the cylinder into the closed position;

wherein; when the cylinder is locked into the closed position, the bolt is biased rearward by the center spring such that the rib does not engage the slot on the transfer bar, and wherein, when the cylinder is not locked into its closed position, the bolt is biased forwardly by a bolt spring such that the bolt rib engages the slot to lock the transfer bar and trigger in place.

15. The revolver of claim 14 comprising a transfer bar limit pin positioned on the frame to limit the forward movement of the transfer bar such that the bolt rib remains sufficiently engaged within the transfer bar slot whenever the cylinder is in the open position.

16. The revolver of claim 15 wherein the transfer bar comprises a curved guide slot within the body of the transfer bar, sized to allow the limit pin to pass therethrough, and wherein the guide slot enables the trigger to move the transfer bar upwardly without interference with the limit pin when the cylinder is closed and the firing mechanism is being actuated.

17. The revolver of claim 1 wherein the hammer and latch mechanism remain substantially fixed relative to each other as the firing mechanism actuates from the set position to the carry-up position.

* * * * *